United States Patent [19]

Ito

[11] Patent Number: 4,619,117

[45] Date of Patent: Oct. 28, 1986

[54] AUTOMATIC ICE MAKING MACHINE

[75] Inventor: Yoshinori Ito, Toyoake, Japan

[73] Assignee: Hoshizaki Electric Company, Ltd., Sakae, Japan

[21] Appl. No.: 818,304

[22] Filed: Jan. 13, 1986

[51] Int. Cl.[4] ..... F25C 1/00

[52] U.S. Cl. ..... 62/233; 62/349

[58] Field of Search ..... 62/233, 347, 348, 157

[56] References Cited

U.S. PATENT DOCUMENTS

| | | | |
|---|---|---|---|
| 3,339,375 | 9/1967 | Fox | 62/233 |
| 3,779,032 | 12/1973 | Nichols | 62/233 |
| 3,964,270 | 6/1976 | Dwyer | 62/233 X |

*Primary Examiner*—William E. Wayner

*Attorney, Agent, or Firm*—Schwartz & Weinrieb

[57] ABSTRACT

In an automatic ice making machine which comprises a freezing chamber formed to define a plurality of open bottom freezing cells, a water plate provided under the freezing chamber for supplying water to be frozen to by spraying the same into the freezing cells, a water tank provided under the water plate for storing a necessary amount of water to be frozen for one freezing cycle, a water inlet valve connected to a feed pipe for supplying water to the water tank, and a water inlet valve controlling timer circuit for controlling the opening and closing of the water inlet valve, and wherein during a defrosting operation, the water plate and the water tank are caused to be inclined downwardly so as to discharge ice cubes the water inlet valve controlling timer circuit comprises a first means for permitting the water inlet valve to open for a first set period of time, a second means for permitting the water inlet valve to open for a second set period of time which is shorter than the first set period of time, and a changeover means which selects the first means only during an initial freezing cycle and switches to the second means during the second and subsequent freezing cycles. The present automatic ice making machine can perform economical freezing operations with such advantages that an insufficient or excessive supply of water to be frozen is not incurred and that ice cubes formed are of proper form, weight, and the like.

6 Claims, 8 Drawing Figures

AUTOMATIC ICE MAKING MACHINE

FIELD OF THE INVENTION

The present invention relates to an automatic ice making machine in which a period of time set by a timer for controlling the opening and closing of a water inlet valve is made automatically changeable and adjustable, whereby an initial freezing cycle, at the time of the power having been supplied to the ice making machine, is made different in time from the second freezing cycle and freezing cycles repeated thereafter for properly feeding water to a water tank so as to solve the problems of shortage of water to be stored in said tank, waste of water due to excessive supply, etc.

BACKGROUND OF THE INVENTION

In an automatic ice making machine which is so arranged that on the top of a freezing chamber having a plurality of open bottom freezing cells, there is provided an evaporator in a serpentine arrangement which is connected to a refrigeration system, water being sprayed into the freezing cells through a water plate so as to form ice therein, and that the completion of forming of the ice is sensed by a heat-sensitive element so as to supply hot gases to the evaporator and at the same time to incline the water plate downwardly, whereby the ice making machine goes into a defrosting operation, and an amount of water required for one freezing cycle is supplied to the water tank through a water inlet valve under the timing control of a timer. A conventional automatic ice making machine is so arranged that during a defrosting operation, the water plate and the water tank provided thereunder in combination therewith are inclined downwardly to drain all of the water remaining in the tank and defrosting water which has been supplied to the water plate through release from the water inlet valve during a defrosting cycle. Thus, it can be pointed out that to drain all of the water to be frozen which remains in the tank during a defrosting cycle, the defrosting water supplied during the cycle and a small amount of thin ice which has come off the water plate through melting is not only uneconomical due to the increase of water consumption but also responsible for such problems that the freezing time and the amount of electric power consumption are increased due to the fact that all the water to be frozen at ordinary temperature which has been newly supplied to the tank is used in the following freezing cycle.

Therefore, for solving the above-described problems, the present applicant proposed an ice making machine in which a predetermined amount of a mixture of residual water to be frozen which has been used during the previous freezing cycle and has now been sufficiently cooled, and defrosting water which is supplied during a defrosting operation is permitted to remain in the water tank for reuse during the following freezing cycle, whereby the saving of water is effected and at the same time a reduction of freezing time and eletric power consumption is accomplished; and completed the procedure for application for Utility Model Registration of the ice making machine as a Device of "Ice making machine" (Japanese Utility Model Registration Application No. 123246/1983). This ice making machine can achieve great advantageous effects from the viewpoint of saving water to be frozen and a reduction of freezing time; on the other hand, since the machine is adapted to supply water to the water tank through a water inlet valve which opens only for a period of time set by the timer, the machine suffers from the problem of production of incompletely-formed ice cubes due to a shortage of the supply of water to be frozen to the tank during an initial freezing cycle when the power has been initially supplied as in the case of a freezing operation starting after an ice making machine has been newly installed. Accordingly, it can be considered, as a countermeasure against this, that the period of time set by the timer can be lengthened; however, this results in the useless overflow of water to be frozen out of the machine during the second and subsequent freezing cycles because water to be frozen is excessively supplied in view of a necessary amount of water having already been supplied to the water tank, which makes the timer control circuit unsuitable for a water-saving type ice making machine.

The present invention has been newly proposed in order to solve the above-described problems; however, for a better understanding thereof, the outline of an arrangement of a conventional water-saving type ice making machine, and the reason for the occurrence of the aforenoted problems thereto, will be described in more detail precedent to a description of the details of the present invention. FIG. 1 and FIG. 2 show the outline of the arrangement of a water-saving type ice making machine capable of achieving the saving of water to be frozen and the reduction of freezing time, in which reference numeral 10 indicates a freezing chamber formed to provide a plurality of open bottom freezing cells 12 in a checkerboard pattern therein, and on the top surface of the freezing chamber 10 there is closely provided an evaporator 14 in a serpentine arrangement which is connected to a refrigeration system. Under the freezing chamber 10, there is provided a water plate 16 which is pivotally supported at one end thereof by means of a pivot 18 so that the water plate 16 can be freely swung downwardly and upwardly and, which is, at the other end thereof, suspendingly supported by means of a coil spring 17 which is elastically stretched between the leading end of a cam lever 34 and the distal end of the water plate. The cam lever 34 is connected to an actuator motor AM, shown in FIG. 3 which will be described hereinafter, to work in combination therewith, whereby during a defrosting cycle the cam lever is driven by motor AM so as to incline the water plate 16 downwardly and thereby free the bottom of the freezing chamber 10 (See FIG. 2). Also, under the water plate 16, there is adjacently provided a water tank 20 which stores a necessary amount of water to be frozen for one freezing cycle, the water tank 20 also being capable of inclining in combination with the water plate 16. Water to be frozen is supplied to the water tank 20 through means of a water inlet valve WV which is opened and closed under the control of a timer which will be described hereinafter and a feed pipe 22 connected thereto, and this water to be frozen is supplied to a feed tube 26 provided at the bottom of water plate 16 through means of a pump 24 which sprays the water into freezing cell 12 through a plurality of spray nozzles 28 which extend through water plate 16 and also communicate with the feed tube 26. In this connection, it should be noted that the cam lever 34 is equipped with a changeover lever 36 at a predetermined angle which effects the switching of a changeover switch SW shown in FIGS. 1–3, whereby the changeover switch SW is switched to connection of contacts (c-a) in FIG. 3 during the time when the water tank 20 is in a horizontal position, and is switched to connection of contacts (c-b) during the time when the tank is in an inclined-and-stopped position; thereby automatically stopping the water tank 20 in respective positions.

To a side wall of the water tank 20, there is fluidically connected one end of a suitably shaped overflow pipe 30, the other end thereof being open to a drainage pan 38 provided under the tank. When the tank 20 is in a freezing cycle position in which the tank is held in a horizontal position as shown in FIG. 1, level C (for example 6.5 lit.) representing a necessary amount of water to be frozen to be maintained, while at the time of the tank being in a defrosting cycle position in which the tank is in an inclined-and-stopped position, a water amount level D as seen in FIG. 2 (for example 5 lit.) is maintained, in both of the cases the positioning being so arranged that a surplus supply of water is permitted to overflow through overflow pipe 30 into the drainage pan 38 to in turn be drained out of the machine through drainage port 40.

When the freezing operation starts under the condition of the water plate 16 and the water tank 20 being held in a horizontal position as shown in FIG. 1, water to be frozen is sprayed into each freezing cell 12 and cooled by the evaporator 14, forming ice cubes gradually in accordance with the advance of freezing. At this point, in FIG. 3, the changeover switch SW is connected with contacts (c-a), as seen and a freezing sensing thermostatic switch $Th_1$ is open while a defrosting sensing thermostatic switch $Th_2$ is closed with contacts (e-g). In addition, normally-open switch TM-a which cooperates with a timer TM is open. As a result of the water to be frozen being consumed in producing ice, the level of the water remaining in the tank 20 at the end of the freezing cycle is lowered to line E (for example 3.2 lit.) as seen in FIG. 1. In this connection, it should be noted that water remaining unfrozen in each freezing cell 12 is collected in the tank 20 through means of a plurality of drainage holes 32 formed within plate 16 adjacent to each spray nozzle 28 so as to be pumped again by means of pump 24 for circulation.

When the forming of ice cubes is completed, the freezing-sensing thermostatic switch $Th_1$ shown in FIG. 3 operates to close the contacts thereof, and through such contacts and the contacts (c-a) of the changeover switch SW the actuator motor AM is energized, whereby the cam lever 34 is turned around so as to downwardly incline the water plate 16 and the water tank 20 as shown in FIG. 2. In accordance with the turning-around movement of the cam lever 34, the changeover lever 36 provided thereon causes the changeover switch SW to switch to the connection between the contacts (c-b). This energizes a hot valve HV through the contacts (e-g) of the defrosting sensing thermostatic switch $Th_2$ so as to open the valve whereby hot gases are supplied to the evaporator 14 to heat the freezing cells 12, thereby accelerating the discharge of ice cubes therefrom. The changeover operation of the switch SW de-energizes the water inlet valve controlling timer circuit TM, closing normally-open time limit switch TM-a which cooperates with a relay X incorporated in the timer circuit TM, thereby opening the water inlet valve WV so as to supply defrosting water to the water plate 16 through means of the feed pipe 22. The defrosting water not only melts thin ice formed on the water plate so as to thereby cause the thin ice to come off but is also cooled by heat exchange and then collected within the water tank 20. This supply of defrosting water is continued for a predetermined time even after the defrosting sensing thermostatic switch $Th_2$ has sensed the discharge of ice cubes and caused the water tank 20 to return to its original position, whereby the remaining water to be frozen in the tank 20 which has become somewhat lower in quality is mixed and diluted with the defrosting water so as to thereby prevent further deterioration of the quality of the water. In this connection, it should be noted that when the tank is in its inclined-and stopped position, the level of the mixture of the water is maintained at the level D (for example 5 lit.) by means of the overflow pipe 30.

In accordance with the advance of the defrosting cycle, the contacts of the freezing sensing thermostatic switch $Th_1$ are reset to the open (OFF) position, and then all the ice cubes are simultaneously discharged from their respective freezing cells 12 so as to slide down the water plate 16 to be collected in an ice cube bin (not shown). When the contacts (e-g) of the defrosting sensing thermostatic switch $Th_2$ open, the other contacts (e-f) of switch $Th_2$ are simultaneously closed so as to reversely drive the motor AM whereby the water plate 16 and the water tank 20 are moved back to their original positions as shown in FIG. 1. During this time, the hot valve HV is closed so as to stop the supply of hot gases, and the flow of refrigerant gases is also restarted. This returning action of plate 16 and tank 20 accompanies the resetting of the connection of the changeover switch SW to the position of contacts (c-a) thereby re-energizing the timer TM whereby the water inlet valve WV is kept open for a predetermined period of time (for example 5 seconds) so as to supply water to the water tank 20 until the water therein rises to level C (for example 6.5 lit.) which is the necessary amount of water required for a freezing operation, and then the normally-open contacts TM-a open so as to close the water inlet valve WV. The timing chart of the freezing cycle and the defrosting cycle described heretofore is shown in FIG. 4.

Next, the relationship between the amount of water supplied to the water tank 20 and the water supplying time will be discussed. Now, let it be assumed that the amount of water supplied through the water inlet valve WV is 3 lit./minute, while the necessary amount of water to be frozen within one freezing cycle is 6.5 lit. (level C in FIG. 1). Here, the experimental measurement using an existing apparatus of the time for keeping the water inlet valve WV open shows 100 seconds and the details thereof are as follows:

(A) Time during which the water tank is in an inclined-and-stopped position ($T_1$): 60 seconds.

(B) Time during which the water tank rises back to its original position ($T_2$): 35 seconds.

(C) Preset period of time during which the timer TM operates after being energized before the cooperating contacts TM-a thereof open ($T_3$): 5 seconds.

When the water tank 20 is in an inclined-and-stopped position, the water to be frozen which has remained within tank 20 after consumption in the preceding freezing cycle is 3.2 lit. (level E in FIG. 1) as described hereinbefore, and to this water there is supplied 3 lit. of defrosting water over a period of time ($T_1$) of 60 seconds while the tank is in an inclined-and-stopped position, the total of the water therefore amounting to 6.2 lit. Accordingly, the amount of water in the tank 20 in an inclined-and-stopped position comes to exceed the water level D which corresponds to 5 lit., this amount of the water mixture comprising the total of the water to be frozen remaining in tank 20, and the defrosting water added thereto, as determined or maintained by the overflow tube 30. Besides, 2 lit. of new water is supplied over a period of time ($T_2$) of 35 seconds which is the time required for swinging the water tank back to its original position and a subsequent period of time ($T_3$) of 5 seconds during which the supply of water through the water inlet valve WV is continued by the timer TM; accordingly, in the tank 20 which has been swung back to its horizontal position, the water sufficient for 6.5 lit., the amount which is necessary for a freezing operation is achieved. In addition, any surplus amount of the water is drained out of the machine through the overflow pipe 30.

Although there is no problem so long as the usual freezing cycles are repeated, since the water quality is improved by mixing water to be frozen remaining in the tank with newly supplied water and the saving of water to be frozen in tank 20 and a reduction of freezing time are also effected; when an initial freezing cycle starts as in the case of a newly-installed ice making machine starting a freezing operation, the following inherent problems arise. For example, in an initial freezing cycle, the water to be frozen and remaining in the water tank 20 is zero, and moreover, the freezing cells are also at ordinary temperature and not as yet cooled, with the defrosting sensing thermostatic switch $Th_2$ being connected between the contacts (e-f) in FIG. 3. Upon energizing the ice making machine, the water tank 20 swings and changes the connection of the changeover switch SW to that of contacts (c-b), whereby the water tank 20 starts swinging upwardly. In this state, the water inlet valve WV opens for 40 seconds, and the details of the time are as follows:

(A) Time during which the water tank is in an inclined-and-stopped position: 0 seconds.

(B) Time during which the water tank starts swinging upwardly and completes entering into a freezing operation stand-by position: 35 seconds.

(C) Time until the water inlet valve WV is opened by the timer TM: 5 seconds.

The amount of water to be frozen supplied to the tank 20 during the 40 seconds is 2 lit., which brings about a great shortage of 4.5 lit. relative to 6.5 lit., which is the necessary amount of water to be frozen within one freezing cycle. When the initial freezing operation is carried out under such a condition that the water to be frozen is insufficient, the ice cubes formed are incompletely shaped and the weight of each cube is insufficient. As a countermeasure against the shortage of the supply water at the start of an initial freezing cycle, it is only necessary that the timer TM be predetermined for a longer set period of time, thereby prolonging the time for keeping the water inlet valve WV open so as to compensate for the insufficient amount of the supply water; however, the time for keeping the valve open which is considered to be necessary for the supply of the insufficient amount of water, 4.5 lit., amounts to as long as 50 seconds. Accordingly, at the start of an initial freezing cycle, the necessary amount of water can be provided during the preset time ($T_3$) of 95 seconds; however, during the second freezing cycle and subsequent freezing cycles thereafter, an excess of 4.5 lit. of water is drained out of the machine since the preset period of time $T_3$ of the timer TM, for which 5 seconds is sufficient, exceeds the necessary period of time by 90 seconds (95 seconds minus 5 seconds), which makes the timer control circuit unsuitable for use in the water-saving type ice making machine.

SUMMARY OF THE INVENTION

The present invention has been proposed on the basis of the above-described background, and the object thereof is to prevent the insufficient supply of water to be frozen during an initial cycle and an excessive supply thereof during the subsequent freezing cycles.

For suitably achieving this object, according to the present invention, in an ice making machine which comprises a freezing chamber formed to provide a plurality of open bottom freezing cells, a water plate provided under the freezing chamber for supplying water to be frozen by spraying the same into the freezing cells, a water tank provided under the water plate for storing a necessary amount of water to be frozen for one freezing cycle, a water inlet valve connected to a feed pipe for supplying water to the water tank, and a water inlet valve controlling timer circuit for controlling the opening and closing of the water inlet valve, and is so arranged that, during a defrosting operation, the water plate and the water tank are caused to be inclined downwardly to discharge ice cubes; the water inlet valve controlling timer circuit comprises a first means for permitting the water inlet valve to open for a first set period of time, a second means for permitting the water inlet valve to open for a second set period of time which is shorter than the first set period of time, and a changeover means which selects the first means only during an initial freezing cycle and switches to the second means during the second and subsequent freezing cycles.

The automatic ice making machine, which is adapted to be capable of changing or adjusting the period of time set for keeping the water inlet valve open so as to permit the supply of water to the water tank in such a manner that an initial freezing cycle is made different from the second freezing cycle and freezing cycles repeated thereafter, can perform economical freezing operations with such advantages that an insufficient or excessive supply of water to be frozen as described hereinbefore is not incurred and that ice cubes formed are of proper form, weight, and the like.

BRIEF DESCRIPTION OF THE DRAWINGS

Various other objects, features, and attendant advantages of the present invention will be more fully appreicated as the same becomes better understood from the following detailed description when considered in connection with the accompanying drawings, in which like reference characters designate like or corresponding parts throughout the several views, and wherein.

DESCRIPTION OF THE PREFERRED EMBODIMENTS

Figure 3:
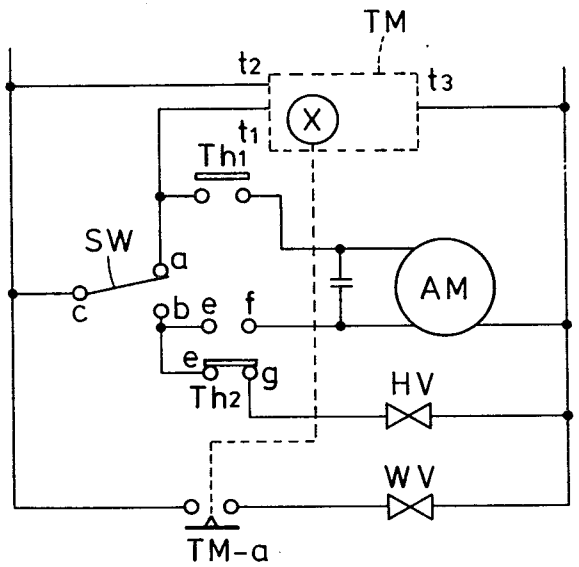
FIG. 3 PRIOR ART
FIG. 3 is a circuit diagram of a defrosting control circuit for use in the water-saving type automatic ice making machine shown in FIG. 1.
Figure 5:
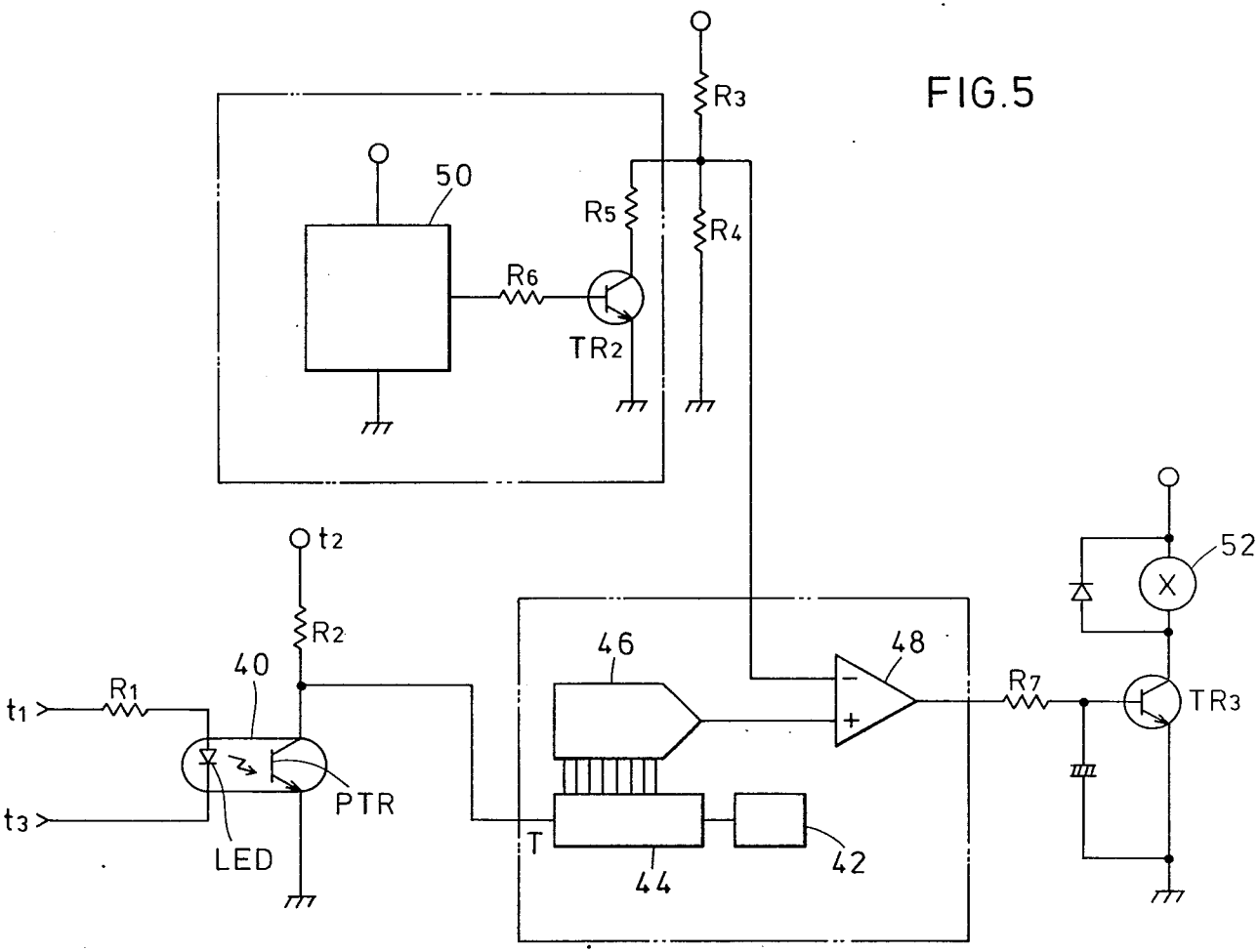
FIG. 5 is a circuit diagram of the water inlet valve timer control circuit according to the first embodiment of the present invention.

Referring now again to the drawings, FIG. 5 shows a basic configuration of a water inlet valve controlling timer circuit which is a principal part of the automatic ice making machine according to the first embodiment of the present invention, and this water inlet valve controlling timer circuit can directly replace the conventional timer TM for connection in the defrosting control circuit shown in FIG. 3. The water inlet valve controlling timer circuit shown in FIG. 5 is basically composed of a setting circuit 40 which supplies a resetting input or a setting input to a counter provided in the latter part thereof by switching the voltage from a high level to a low level in response to external signals, a counter 44 which starts the counting of pulses sent from an oscillation circuit 42 after receiving the setting input, a comparator 48 which, with binary outputs from the counter 44 being subjected to D/A conversion in a D/A converter 46, thereafter applies a voltage rising in proportion to an integrated value of pulses to a non-inverting input terminal $V_{in}+$ and, at the same time applies a set reference voltage to an inverting input terminal $V_{in}-$, thereby comparing both the voltages, voltage-dividing resistances $R_3$ and $R_4$ for setting a reference voltage value to be input to the comparator 48, a switching circuit $TR_2$ which lowers the set reference voltage by insertion of a resistance $R_5$ in parallel with the voltage-dividing resistance $R_4$, a timer circuit 50 which operates only during an initial cycle when the ice making machine is energized, and inverts the output after a predetermined time has passed so as to thereby energize the switching circuit $TR_2$, whereby the set reference voltage is changed in value to alter the output time from the comparator 48, and a relay circuit 52 which opens or closes the water inlet valve WV depending on the output from the comparator 48.

The setting circuit 40 basically comprises a photocoupler, and the anode of a light-emitting diode LED integrated in the photocoupler is connected to contact a of the changeover switch SW shown in the circuit of FIG. 3 through the resistance $R_1$ and terminal $t_1$, while the cathode of the diode LED is connected to ground through a terminal $t_3$. A phototransistor PTR incorporated in the photocoupler is grounded by its emitter, the collector thereof being connected to the power supply line through the resistance $R_2$ and at the same time connected to an input terminal T of the counter 44. In this connection, it should also be noted that the oscillator 42 supplies pulses to the counter 44.

The binary outputs from the counter 44 are input to a D/A converter 46 to be subjected to D/A conversion therein, and then input to a non-inverting input terminal $V_{in}+$ of the comparator 48. On the other hand, the inverting input terminal $V_{in}-$ of the comparator 48 is connected to the junction of the resistance $R_3$ and resistance $R_4$, whereby to the comparator there is applied a reference voltage set by this voltage-dividing resistance.

When a predetermined time (for example not less than 95 seconds, which is sufficient for supplying a sufficient portion, 6.5 lit., and is within a period of time necessary for an initial freezing cycle) has passed after the ice making machine has been energized, the timer circuit 50 operates to output a high level voltage and apply a base voltage to the switching transistor $TR_2$ through the resistance $R_6$ (the transistor $TR_2$ is grounded by its emitter and at the same the collector thereof is connected to the junction of the voltage-dividing resistances $R_3$ and $R_4$ through the resistance $R_5$). As a result of the application of the base voltage, the switching transistor $TR_2$ switches to permit a collector current to flow, whereby the resistance $R_5$ is inserted in parallel with the resistance $R_4$ so as to make it possible to change the reference voltage to a lower voltage value which corresponds to 5 seconds, the timer-set period of time which is required for the second and subsequent freezing cycles.

Figure 1:
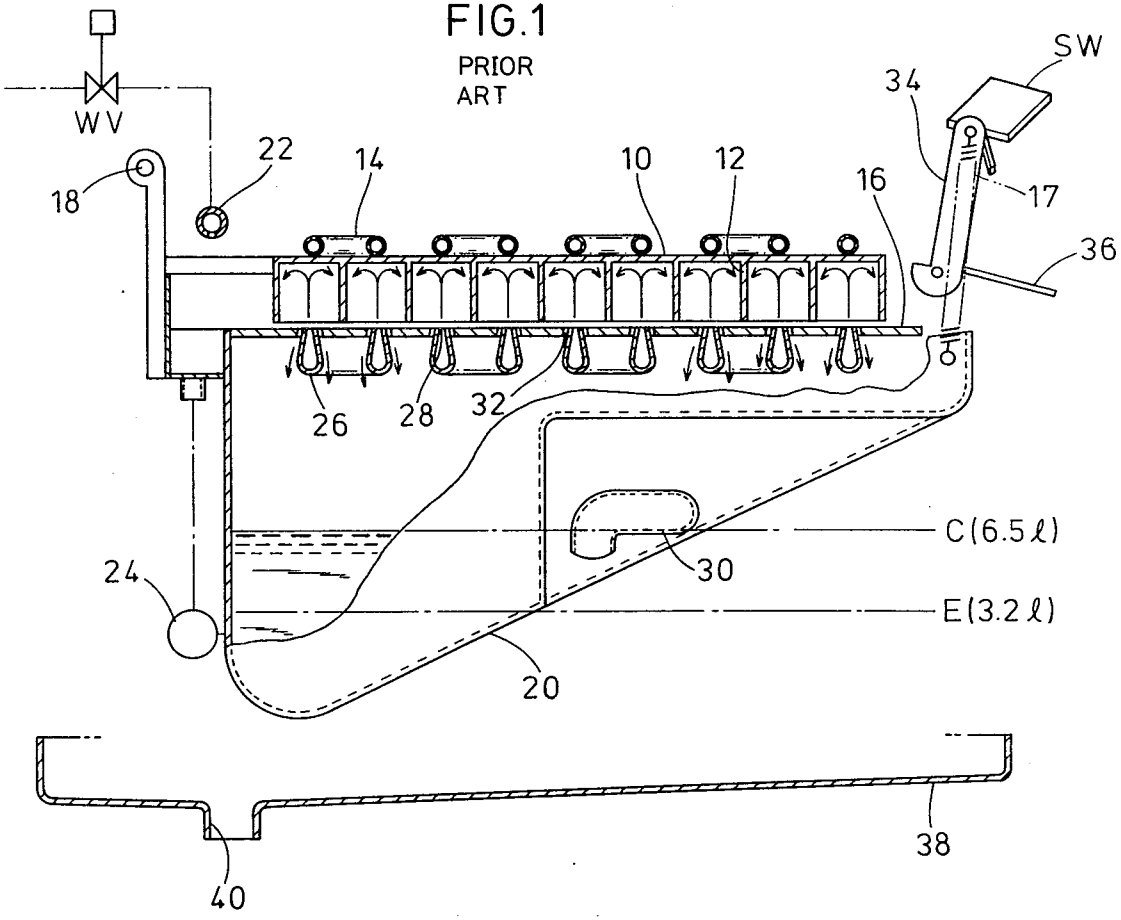
FIG.1 PRIOR ART
FIG. 1 is a schematic drawing of the cross section of a conventional water-saving type automatic ice making machine.
Figure 2:
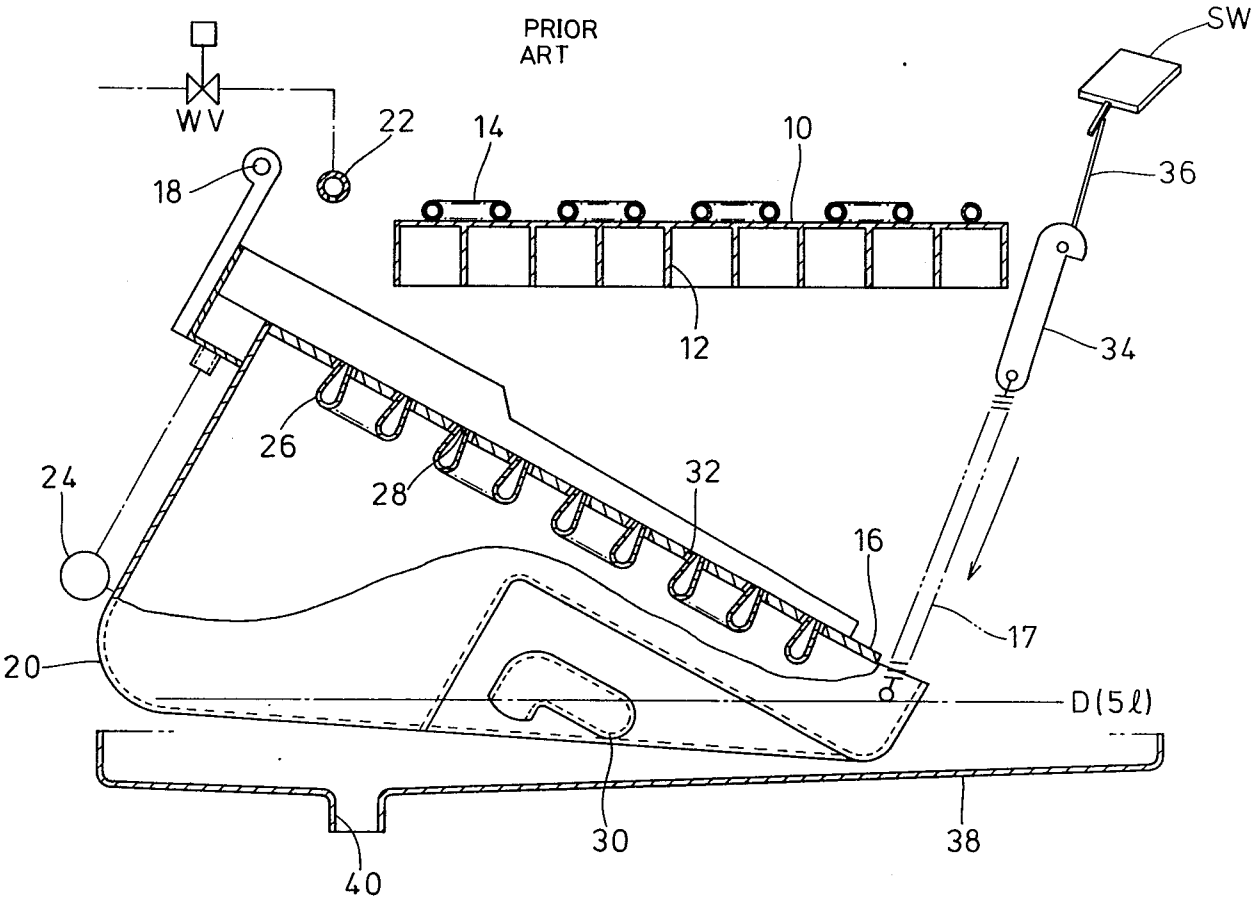
FIG. 2 PRIOR ART
FIG. 2 is a schematic drawing of the cross section of the water plate and water tank of the water-saving type automatic ice making machine shown in FIG. 1 in its inclined state.
Figure 4:
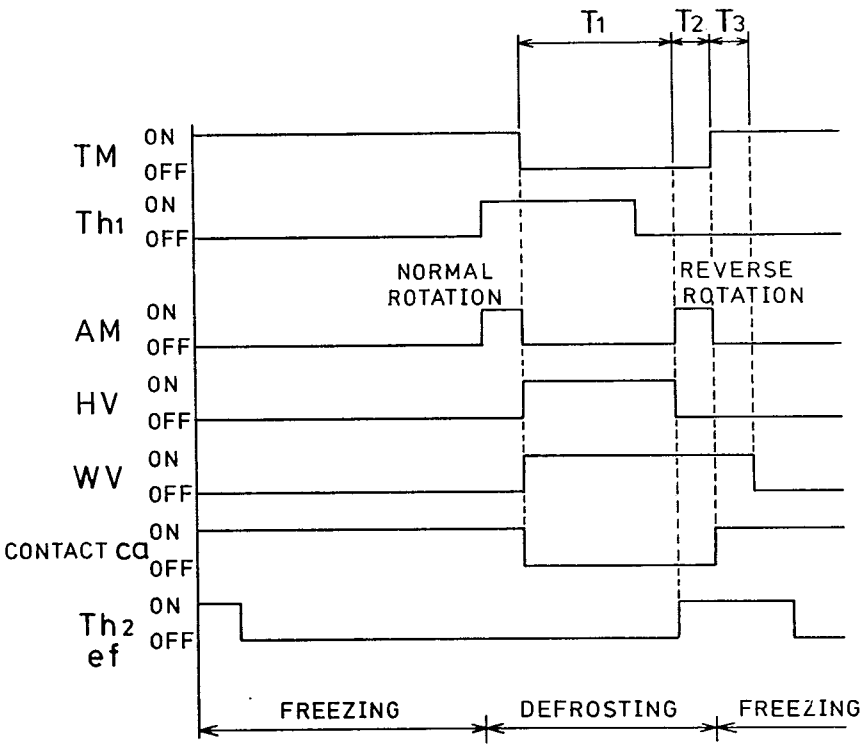
FIG. 4 is a timing chart of component devices shown in FIG. 3 indicating their respective operations.

Next, the operation and effects of the thus-arranged ice making machine according to the present embodiment will be described. As to the water-saving type ice making machine described with reference to FIG. 1 and FIG. 2, let it be assumed that the power has been supplied for starting an initial freezing cycle. The water tank 20 inclines downwardly as shown in FIG. 2; however, since the defrosting sensing thermostatic switch $Th_2$ is connected between the contacts (e-f), the motor AM is reversely energized so as to swing and return the water tank 20 to its original horizontal position. This causes switching of the changeover switch SW to the connection between the contacts (c-a) so as to permit an electric current to flow between the terminals $t_1$ and $t_3$ of the timer TM in the circuit shown in FIG. 3. This causes the light emitting diode LED to emit light, which permits a photocurrent to flow between the base and the emitter of the phototransistor PTR incorporated in the photocoupler, the phototransistor PTR conducting an electric current to allow a collector current to flow therein. This changes the input voltage to the counter 44 from a high level to a low level. To the counter 44, as is described hereinbefore, there are supplied pulses from the oscillator 42, and by the setting input of the low level signal the counter 44 starts counting the pulses, supplying the binary output thereof to the D/A converter 46. The output of the D/A converter 46 appears as a voltage increase in proportion to the value calculated by the counter 44, the output being input to the non-inverting input $V_{in}+$ of the comparator 48. In this connection, it should be noted that the reference voltage set by the voltage-dividing resistances $R_3$ and $R_4$ is input to the inverting input terminal $V_{in}-$ of the comparator 48. The comparator 48, when the voltage applied to the non-inverting input terminal $V_{in}+$ exceeds the set voltage applied to the inverting input terminal $V_{in}-$ thereof, changes its output signal from a low level to a high level, which causes the switching transistor $TR_3$ provided in the relay circuit 52 to switch from its non-conducting state to a conducting state so as to excite the relay X, thereby opening the normally-open contacts TM-a which cooperate therewith to close the water inlet valve WV. Accordingly, there is arranged a water inlet valve controlling timer circuit of the voltage setting type capable of changing and adjusting a timer-set period of time through the changing of the set reference voltage in the comparator 48. This timer-set time lengthens as the value of the set reference voltage is raised and shortens as the voltage value is lowered.

The timer circuit 50 shown in the present embodiment, for example, adopts the CR time-delay method utilizing an integration circuit consisting of a capacitor (C) and a resistance (R), in which when the charge voltage of the capacitor reaches a predetermined voltage, an output is produced to invert the state, thereafter the circuit being stabilized in the new state. Upon the power to the ice making machine being turned on, the timer circuit 50 is energized; at this point, since the output of the timer circuit 50 is at a low level until the set period of time has completely passed and the time elapses, the switching transistor $TR_2$ is in the non-conducting state; therefore, the voltage applied to the inverting input terminal $V_{in}-$ of the comparator 48 has a sufficiently large value which has been determined by the fraction voltage by the resistance $R_3$ and the resistance $R_4$, whereby the time until the output level of the comparator 48 becomes high is predeterminedly long. In other words, upon entering the initial freezing cycle, the water tank 20, as described hereinbefore, swings once and then returns to its horizontal position, at which time the changeover switch SW is connected with the contacts (c-b) to turn off the timer circuit TM, causing the switch TM-a to close, thereby opening the water inlet valve WV. The water continues to be supplied until the total of 35 seconds has elapsed, a period of time necessary for the elevational rise of the tank, and 95 seconds, a period of time set by the timer circuit 50 has passed, and during this sufficiently long set period of time, there is supplied 6.5 lit. of water to be frozen as required for the initial freezing cycle.

When a predetermined period of time set by the timer circuit 50 (for example 130 seconds or more, a period of time sufficient for the supply of 6.5 lit. of water to be frozen in the tank 20, and within 20 minutes, a period of time necessary for the initial freezing cycle) has passed, the output of the circuit changes to a high level, whereby the base voltage is applied to the switching transistor $TR_2$ to bring the transistor $TR_2$ into the conducting state to cause a collector current to flow. This causes the resistance $R_5$ to be newly inserted in parallel with the voltage-dividing resistance $R_4$ so as to reduce the voltage applied to the inverting input terminal $V_{in}-$ of the comparator 48, thereby shortening the time set by the timer during the second and subsequent freezing cycles. Namely, by setting the values of $R_3$, $R_4$ and $R_5$ so that the set reference voltage applied to the comparator is given a value capable of giving a timer-set period of time necessary for the second and subsequent freezing cycles, for example, 5 seconds, the ice making machine operates, following the above-described sequence, to achieve the supply of a necessary amount, for example 6.5 lit., of water to be frozen during the second and subsequent cycles.

Figure 6:
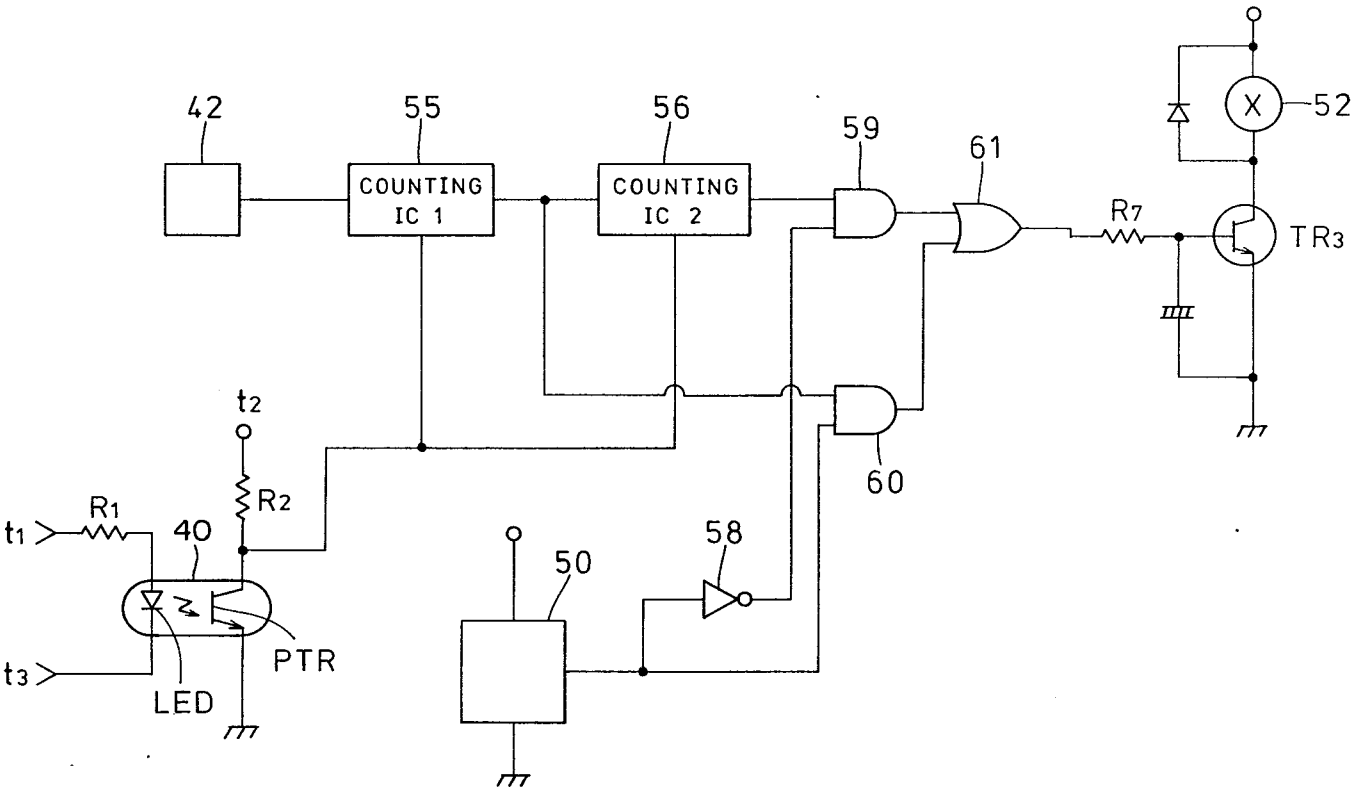
FIG. 6 is a circuit diagram of the water inlet valve timer control circuit according to the second embodiment of the present invention.

FIG. 6 shows a configuration of the water inlet valve controlling timer circuit according to the second embodiment of the present invention. In FIG. 6, the output of the setting circuit 40 having the same arrangement as that in FIG. 5, is sent to the resetting terminals of the counting IC 55 and counting IC 56. The counting IC 55 and counting IC 56 are cascade-connected, with the clock pulses from the oscillator 42 being supplied to the counting IC 55. This counting IC 55, after 5 seconds have passed since the voltage applied to the resetting terminals is changed from a high level to a low level, changes its output signal from a low level to a high level, while the counting IC 56, changes its output signal from a low level to a high level after 95 seconds+35 seconds. In addition, the counting IC 55 and counting IC 56 consist of flip-flop circuits.

The output of a timer circuit 50 similar to that descibed in FIG. 5 is inverted by means of an inverter 58, and the logical product of the inverted output of the timer circuit 50 and the output of the counting IC 56 is produced by AND gate 59, while the logical product of the output of the timer circuit 50 and the output of the ocunting IC 55 is produced by AND gate 60. The logical sum of the output of AND circuit 59 and that of AND circuit 60 is produced by OR gate 61, the output of the OR gate 61 performing the ON/OFF control of the transistor $TR_3$. In the follwing description, the period of time set by the timer circuit 50 is set shorter than the freezing time of one cycle and at the same time longer than 130 seconds, water-supplying time during the initial cycle.

In accordance with such a configuration, upon the power being applied between the terminals $t_1$ and $t_3$, the voltage applied to the resetting terminals of the counting IC 55 and counting IC 56 is changed from a high level to a low level, and the counting IC 55 and counting IC 56 start the counting of clock pulses from the oscillator 42. At this point, since the outputs of both the counting IC 55 and counting IC 56 are at a low level, the output of OR gate 61 is at a low level. Accordingly, the trasistor $TR_3$ is in the non-conducting state while the switch TM-a to be opened or closed by the relay 52 continues to be in the ON state.

In the case of an initial cycle, the timer circuit 50, due to the fact that the set period of time has not elapsed, produces an output at a low level. Accordingly, AND gate 60 always produces a low level output regardless of the output of the counting IC 55, while the AND gate 59 keeps the output of the counting IC 56 in the through state. Therefore, when the counting IC 56 has counted 130 seconds and changed its output to a high level, the transistor $TR_3$ is brought into the conducting state to open the TM-a.

During the second and subsequent cycles, since the period of time set by the timer circuit 50 has elapsed, the output of AND gate 59 is always at a low level while the AND gate 60 keeps the output of the counting IC 55 in the through state. Accordingly, the contacts of switch TM-a open after 5 seconds has elapsed since an electric current was conducted between the terminals $t_1$ and $t_3$.

In this manner, the time for supplying water is prolonged only during the initial cycle and is shortened during the second and subsequent cycles to effect the saving of water. In addition, in the first and the second embodiments, since the period of time set by the timer circuit 50 has a wide range of tolerance and there is no requirement of exact accuracy, there is the advantage that inexpensive and simple circuits can be used.

Figure 8:
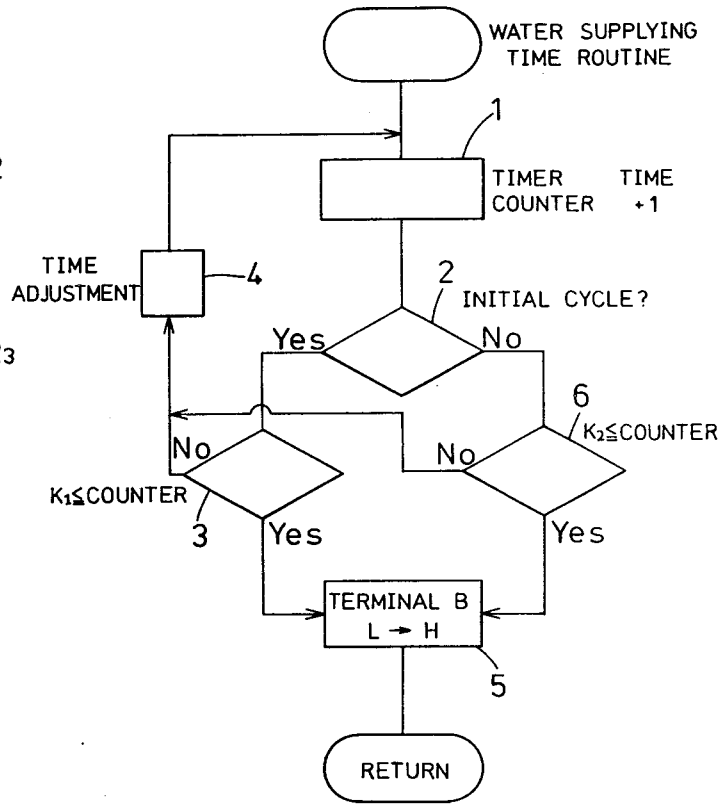
FIG. 8 is a flow chart of the program executed by the microcomputer shown in FIG. 7.
Figure 7:
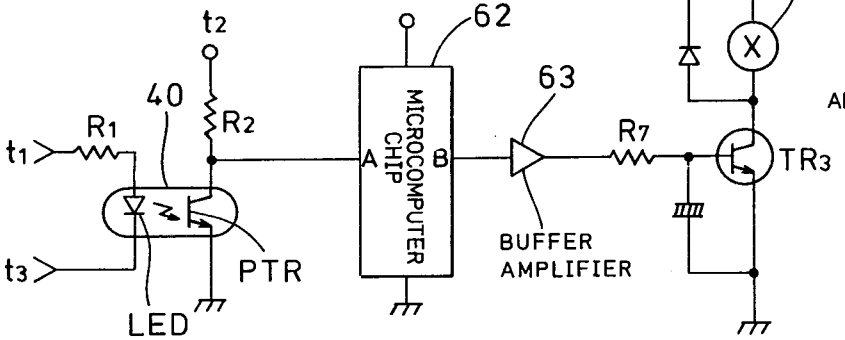
FIG. 7 is a circuit diagrm of the water inlet valve timer control circuit according to the third embodiment of the present invention.

FIG. 7 shows a configuration of the water inlet valve controlling timer circuit according to the third embodiment of the present invention, which is so arranged that the output of the setting circuit 40 having the same arrangement as that in FIG. 5 is supplied to the A-terminal of a microcomputer 62, while the B-terminal output of the microcomputer 62 is applied to the base of the transistor $TR_3$ through the buffer amplifier 63. When the flow of electricity between the terminals $t_1$ and $t_3$ is cut off so as to change the A-terminal input voltage of the microcomputer 62 from a low level to a high level, the B-terminal output is changed to a low level, thereby bringing the transistor $TR_3$ into the non-conducting state. When the contacts c-a shown in FIG. 3 are closed, electricity flows between the terminals $t_1$ and $t_3$, whereby the A-terminal input voltage of the microcomputer 62 is changed from a high level to a low level, starting a routine for a water supplying timer shown in FIG. 8.

In this routine, an internal counter (soft counter may be used) for counting time count clock pulses to effect a +1 increment is initially performed as Step 1, and then whether or not the freezing cycle is an initial one is judged as Step 2. In the case of the freezing cycle being initial, the operation proceeds to Step 3 to judge whether the content of the counter has reached or exceeds a predetermined number $K_1$ corresponding to 130 seconds. In the case of the predetermined number $K_1$ not being reached, time adjustment is carried out (Step 4) to await the next clock input, and the operation returns again to Step 1, thereafter repeating the process of Steps 1, 2, 3 and 4 until the content of the counter has reached the predetermined number $K_1$. When the content of the counter has reached the predetermined number $K_1$ or 130 seconds have passed since the ice making machine was energized, the operation proceeds to Step 5, thereby changing the output voltage of the B-terminal of the microcomputer 62 from a low level to a high level so as to thereby energize the transistor $TR_3$.

In the case of the freezing cylcle being judged to be not an initial cycle in Step 2, the operation proceeds to Step 6 to judge whether or not the content of the counter has reached a predetermined number $K_2$ which corresponds to, for example, 5 seconds. In the case of the predetermined number $K_2$ not being reached, the process of Steps 4, 1, 2 and 6 is repeated as described above, and in the case of the predetermined number $K_2$ being reached, the operation proceeds to Step 5 to change the output voltage of B-terminal from a low level to a high level so as to thereby energize the transistor $TR_3$.

Thus, the water supply time setting for the second and subsequent cycles can be shortened to effect the saving of water.

Obviously, many modifications and variations of the present invention are possible in light of the above teachings. It is therefore to be understood that within the scope of the appended claims, the present invention may be practiced otherwise than as specifically described herein.

What is claimed is:

1. In an automatic ice making machine which comprises a freezing chamber formed to define a plurality of open bottom freezing cells, a water plate provided under the freezing chamber for supplying water to be frozen to spray said water into the freezing cells, a water tank provided under the water plate for storing a necessary amount of water to be frozen for one freezing cycle, a water inlet valve connected to a feed pipe for supplying water to the water tank, and a water inlet valve controlling timer circuit for controlling the opening and closing of the water inlet valve, wherein during a defrosting portion of the ice-making cycle, the water plate and the water tank are caused to be inclined downwardly so as to discharge ice cubes, said water inlet valve controlling timer circuit comprising:

first means for permitting said water inlet valve to open for a first predetermined period of time, second means for permitting said water inlet valve to open for a second predetermined period of time which is shorter than said first predetermined period of time, and changeover means which selects said first means only during an initial freezing cycle and switches to said second means during second and subsequent freezing cycles.

2. The automatic ice making machine according to claim 1, in which said water inlet valve controlling timer circuit comprises:

a comparator to which an analog voltage corresponding to a counted value of clock pulses is supplied, a first voltage-dividing resistance for setting a reference voltage of the comparator to a value corresponding to the first predetermined period of time, and a second voltage-dividing resistance for setting a reference voltage of the comparator to a value corresponding to the second predetermined period of time.

3. The automatic ice making machine according to claim 1, in which said water inlet valve controlling time circuit comprises:

a first counter for counting the first predetermined period of time, and a second counter for counting the second predetermined period of time.

4. The automatic ice making machine according to claim 2, in which:

said switching by said changeover means is performed within the range between said first predetermined period of time and the initial freezing cycle terminating time.

5. The automatic ice making machine according to claim 3, in which:

said switching by said changeover means is performed within the range between said first predetermined period of time and the initial freezing cycle terminating time.

6. The automatic ice making machine according to claim 1, in which said water inlet valve controlling timer circuit comprises a microcomputer.

* * * * *